US006499670B1

(12) United States Patent
Brown et al.

(10) Patent No.: US 6,499,670 B1
(45) Date of Patent: Dec. 31, 2002

(54) DIRECTIONAL CONTROL VALVE AND VALVE ASSEMBLY IN AN ASPHALT DISTRIBUTOR

(75) Inventors: Thomas R. Brown, Oregon, IL (US); Jeremey Heller, Dixon, IL (US); Patrick O'Brien, Oregon, IL (US)

(73) Assignee: E. D. Etnyre & Co., Oregon, IL (US)

( * ) Notice: Subject to any disclaimer, the term of this patent is extended or adjusted under 35 U.S.C. 154(b) by 0 days.

(21) Appl. No.: 09/255,683

(22) Filed: Feb. 23, 1999

(51) Int. Cl.[7] ..... B05B 1/16

(52) U.S. Cl. ..... 239/170; 239/172; 239/132.1; 239/446; 137/627.5; 222/318; 222/424

(58) Field of Search ..... 137/627.5; 239/146, 239/159, 170, 172, 132.1, 160, 127, 436, 443, 444, 446; 222/318, 424

(56) References Cited

U.S. PATENT DOCUMENTS

| | | | | | |
|---|---|---|---|---|---|
| 1,668,309 | A | * | 5/1928 | Etnyre | 239/127 |
| 1,778,551 | A | | 10/1930 | Etnyre | |
| 2,011,894 | A | | 8/1935 | Etnyre | 299/34 |
| 2,046,373 | A | | 7/1936 | Etnyre | 299/34 |
| 2,372,065 | A | | 3/1945 | Etnyre | 299/34 |
| 2,472,199 | A | | 6/1949 | Etnyre | 299/34 |
| 2,505,390 | A | | 4/1950 | Etnyre | 299/34 |
| 2,571,850 | A | | 10/1951 | Etnyre | 299/34 |
| 2,599,704 | A | | 6/1952 | Etnyre | 299/34 |
| 2,800,365 | A | * | 7/1957 | Hodges | 137/625.47 |
| 3,143,295 | A | * | 8/1964 | Booker | 239/127 |
| 3,239,148 | A | | 3/1966 | Etnyre | 239/159 |
| 3,784,100 | A | * | 1/1974 | Kirschmann | 239/11 |
| 3,838,817 | A | | 10/1974 | Hill | 239/125 |
| 4,274,586 | A | | 6/1981 | Hill | 239/125 |
| 4,311,274 | A | * | 1/1982 | Neal | 239/1 |
| 4,817,870 | A | * | 4/1989 | Dalton | 239/157 |
| 4,960,242 | A | | 10/1990 | Larson | 239/168 |
| 5,472,009 | A | * | 12/1995 | Linderoth | 137/101 |
| 5,522,543 | A | * | 6/1996 | Herzog | 137/527.8 |
| 5,957,621 | A | * | 9/1999 | Clark et al. | 239/159 |
| 6,161,775 | A | * | 12/2000 | Brown et al. | 239/132.1 |

* cited by examiner

*Primary Examiner*—Michael Mar
*Assistant Examiner*—Darren Gorman
(74) *Attorney, Agent, or Firm*—Leydig, Voit & Mayer, Ltd.

(57) ABSTRACT

A directional control valve having three positions controls the direction of flow through an asphalt distributor. The directional control valve is interposed between a pump and a feed line assembly to a spray bar. The directional control valve has a first position in which flow is recirculated through the pump, a second position in which flow is delivered to the spray bar and a third position providing for handspray and transfer operations. A pressure relief valve is provided for controlling return flow of asphalt from the spray bar to the tank. The pressure relief valve is open in spray bar circulation mode and is closed during a spraying mode. According to the preferred embodiment the directional valve and pressure relief valve are contained within a modular control valve assembly. The directional control valve eliminates the need to reverse the flow in one of the individual feed lines and feed line assembly connecting the modular control valve assembly to the spray bar. The feed line assembly includes a delivery and return line running coaxial or otherwise adjacent for heat transfer therebetween. The directional control valve reduces the quantity and lengths of exposed valving and plumbing associated with prior asphalt distributors.

21 Claims, 8 Drawing Sheets

ASPHALT TANK
30

21
HANDSPRAY
47
48
27
44
OFF-LOADING
40
46
45
20
27
36
27
32
34
22
DIRECTIONAL CONTROL VALVE
42
43
LOADING
38
26
52
62
24
54
53
50
58
55
28A
29
28
58
28B
56
56
56
59
31
59

ASPHALT TANK
30

TRANSFER
21
HANDSPRAY
47
48
OFF–LOADING
27
44
40
46
45
22
20
27
36
27
32
34
42
43
LOADING
38
26
52
62
24
54
53
50
58
55
28A
29
28
58
28B
56
56
56
59
31
59

ASPHALT TANK
30

RECIRCULATION
21
HANDSPRAY
47
48
OFF-LOADING
27
44
40
46
45
22
20
27
36
27
32
34
42
43
LOADING
38
26
52
62
24
54
53
50
58
55
28A
29
28
58
28B
56
56
56
59
31
59

CIRCULATION THRU SPRAY BAR
ASPHALT TANK
30
21
HANDSPRAY
47
48
OFF-LOADING
27
44
40
46
45
20
22
27
36
27
32
34
42
43
LOADING
38
26
52
62
24
54
53
50
58
55
28A
29
28
58
28B
56
56
56
59
31
59

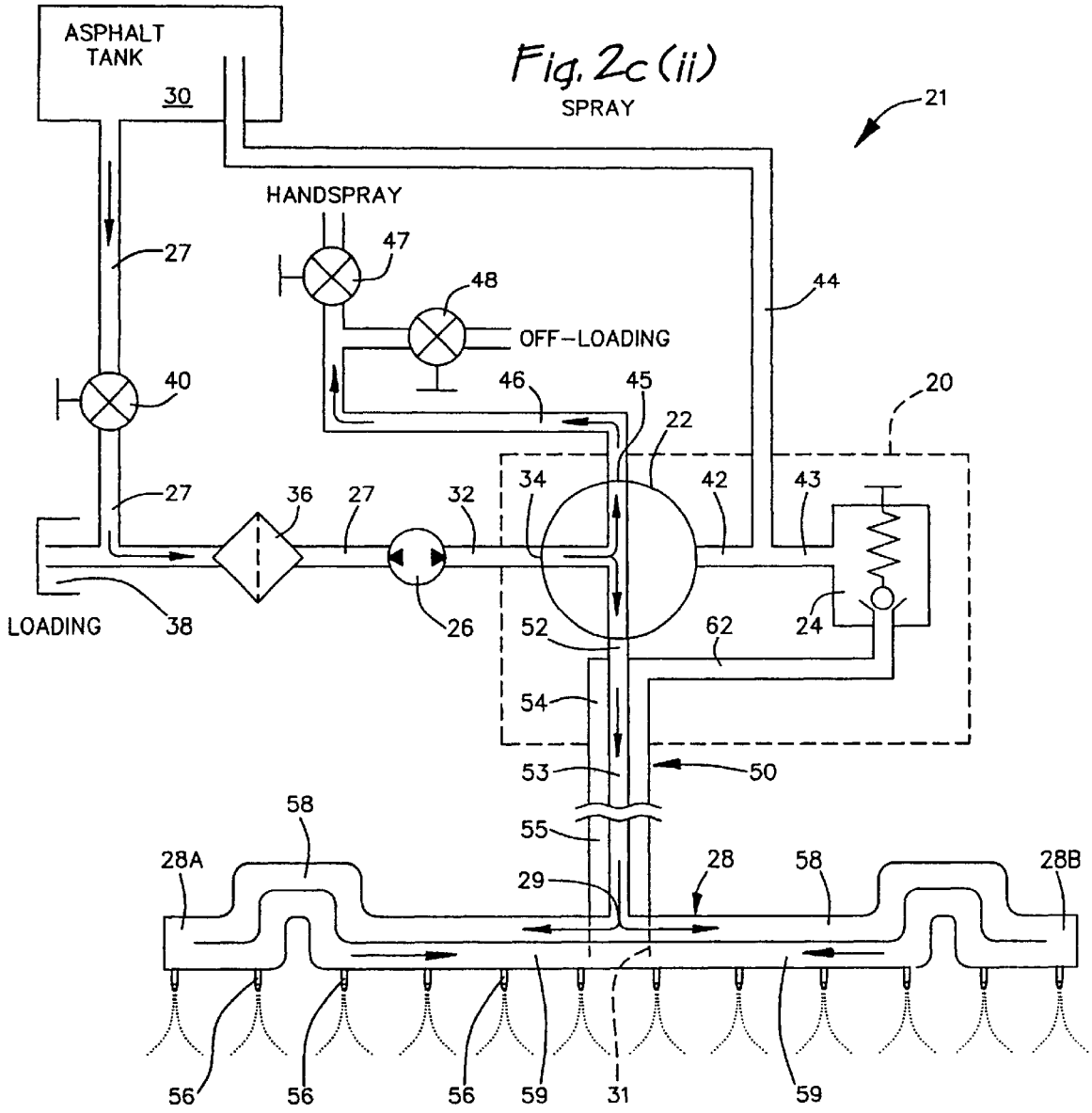
ASPHALT TANK
30
Fig. 2c (ii)
SPRAY
21
HANDSPRAY
47
48
OFF-LOADING
44
27
40
46
45
20
22
27
36
27
32
34
42
43
LOADING
38
26
52
62
24
54
53
50
58
55
28A
29
28
58
28B
56
56
56
59
31
59

DIRECTIONAL CONTROL VALVE AND VALVE ASSEMBLY IN AN ASPHALT DISTRIBUTOR

FIELD OF THE INVENTION

The present invention generally relates to asphalt distributors and more particularly relates to control valves in the circulating systems of asphalt distributors.

BACKGROUND OF THE INVENTION

Asphalt distributors apply hot liquid asphalt to road and other surfaces in a variety of paving applications. Upon cooling, asphalt material becomes more viscous and eventually "freezes" to provide a binder material for pavement. Although it is desired that asphalt freezes upon spray application, it is important to prevent cooling of the asphalt material before spraying, while the asphalt is in the distributor. If asphalt freezes in the distributor, the asphalt can cause serious operating problems such as plugging the system and decreasing uniformity of the spray application.

Asphalt distributors conventionally include a tank, a pump, a spray bar and the plumbing network for communicating asphalt from the tank through the pump to the spray bar. The tank, pump and spray bar are conventionally supported directly by a vehicle such as a truck or supported by a detachable trailer pulled behind the vehicle. The plumbing network of an asphalt distributor preferably performs a number of desired functions, including loading of asphalt into the tank, off-loading asphalt out of the tank, transfer to handspray operations, circulating asphalt in the tank during initial asphalt heating, spraying of asphalt, and circulating asphalt through the spray bar while not spraying to prevent freezing of asphalt therein.

A prior attempt of providing an asphalt distributor is exemplified by Hill, U.S. Pat. No. 4,274,586. Hill provides a circulating system that includes dual feed lines connecting the pump to the spray bar, each feed line being connected near one end of the spray bar. In Hill, flow through one feed line is positive or one directional while the flow through the other feed line is positive or negative (bi-directional) depending upon whether spraying or circulation through the bar is desired. During normal spraying operations, flow through both feed lines is positive to deliver asphalt flow to the spray bar. However, when the distributor is stopped, flow through the bi-directional feed line is typically reversed to circulate asphalt through the spray bar and back to the tank to continuously move the asphalt through the feed lines and spray bar and prevent asphalt from freezing therein. Switching the flow is accomplished with an intermediate conduit having an on/off valve therein selectively connecting the feed lines, an adjustable pressure relief valve in the bi-directional feed line, and a pair of on/off valves in the spray bar.

Problems existing in the art relate to the complexity and cost of providing the circulating network in the asphalt distributor. Prior attempts have typically required complex and multiple valves and extensive lengths of circulating plumbing to reverse the flow of asphalt in one of the feed lines and provide the desired operating functions of an asphalt distributor, while all the time preventing asphalt from freezing and plugging the system. Not only are complex valves expensive but the multiple valve locations which are dictated by the routing of interconnecting plumbing do not provide easy operation or straightforward understanding of operation. For manually operated valves, this requires extra worker training and presents a potential safety hazard. The multiple connections can be prone to assembly difficulties and leaks, and the multiple lengths of exposed plumbing result in excessive heat loss from the asphalt which can lead to freezing or plugging of the system.

SUMMARY OF THE INVENTION

It is therefore the general aim of the present invention to provide an improved approach of directing asphalt flow through the circulating system of an asphalt distributor.

It is another general aim to centralize the control of asphalt flow through the circulation system of an asphalt distributor.

It is another general aim of the present invention to reduce the cost of providing control valving for the circulating system of an asphalt distributor.

It is therefore objects of the present invention to reduce the complexity of valving in a circulating system of an asphalt distributor while providing for multiple desire operating features.

It is a further objective of the present invention to provide a circulating system in an asphalt distributor that is easier to use, and therefore which is safer to workers.

It is a subsidiary object of the present invention to reduce the lengths of exposed plumbing in a circulating system of an asphalt distributor.

It is another subsidiary object of the present invention according to a preferred embodiment to eliminate the need to reverse the flow in one of the feed lines to the spray bar in the circulating system of an asphalt distributor.

It is therefore a feature of the present invention to provide a directional control valve that has three positions corresponding to four different operating modes of an asphalt distributor. The directional control valve includes an inlet receiving asphalt from a pump, a first outlet to the tank and a second outlet to the spray bar. Control means is provided for selectively positioning the directional control valve. The directional valve includes the first position connecting the inlet to the first outlet for recirculation mode, a second position connecting the inlet to the second outlet for spraying and spray bar circulation modes, and a third position in which the inlet is disconnected from both outlets.

It is an aspect of the present invention that the directional control valve provides a third outlet to a transfer line for operating as off-loading and/or handspray operations. This allows asphalt to continually flow through the directional control valve during transfer operations so as to further prevent freezing of asphalt in the directional control valve.

It is another aspect of the present invention that the directional control valve does not switch the flow through the feed line assembly which delivers asphalt to and from the spray bar. According to the preferred embodiment, the feed line assembly includes a delivery line for one directional delivery flow to the spray bar and a return line for one directional return flow back to the tank. The return line runs coaxially or otherwise adjacent to the delivery line to form a heat exchanger so that static asphalt in the return line is heated by the delivery line to prevent asphalt freezing therein.

It is another feature of the present invention to provide a modular control valve assembly which includes a directional control valve and a pressure relief valve housed in the same valve body. The valve body includes an inlet to the pump, a recirculating outlet for recirculating asphalt to the tank, a delivery outlet for delivering asphalt to the spray bar and a return inlet connected to the spray bar for receiving circulated asphalt from the spray bar. The directional control valve has three positions for alternatively connecting the inlet to the recirculating and delivery outlets. The pressure relief valve is interposed between the return inlet and the recirculating outlet. The pressure relief valve has open and closed positions corresponding to spraying and spray bar circulating modes. During the spraying mode the pressure in the spray bar is low because nozzles on the spray bar are open for discharging asphalt. During spray bar circulation mode, the pressure in the spray bar increases as the nozzles are closed. This causes the pressure relief valve to open thereby allowing asphalt to circulate through the manifold return line and recirculating outlet back to the tank.

It is an aspect of the present invention that the delivery line and return line of the feed line assembly which connects the modular control valve assembly to the spray bar are coaxial or otherwise run adjacent to provide a heat exchanger means for heat transfer therebetween. During the spraying mode, heat is transferred from the delivery line to the return line to prevent freezing of residual or remaining asphalt therein.

These and other objects and advantages of the invention will become more apparent from the following detailed description when taken in conjunction with the accompanying drawings.

Figure 1:
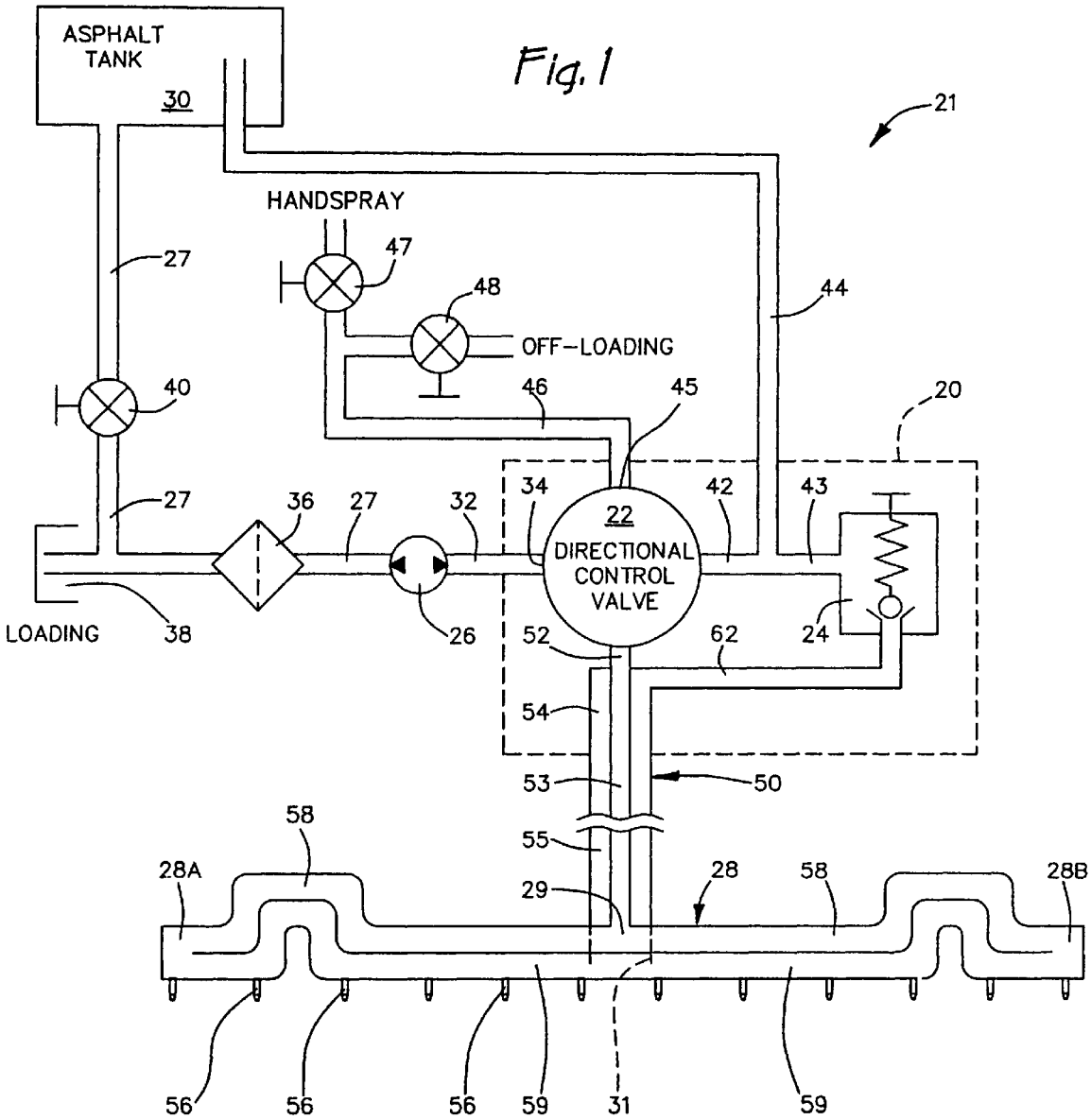
FIG. 1 is a schematic illustration of a coaxial feed line assembly and improved circulating system according to a preferred embodiment of the present invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

For purposes of illustration and referring to FIG. 1, a modular control valve assembly 20 in an asphalt circulating system 21 of a vehicular asphalt distributor is illustrated in accordance with a preferred embodiment of the present invention. The modular control valve assembly 20 includes a directional control valve 22 and a pressure relief valve 24 for controlling the alternative flow paths of asphalt through the system 21.

The circulating system 21 includes a pump 26 for pumping asphalt through the system, a spray bar 28 for discharging asphalt, and plumbing and valving therebetween to provide for several operating modes as will be explained. As shown, the pump 26 is preferably bi-directional so that asphalt flow may be reversed and sucked back from the circulating system 21 after a worksite or workday is completed. The pump 26 is connected by a supply line 27 to an asphalt tank 30 and by a pump output conduit 32 to an inlet 34 of the directional control valve 22. Disposed along the supply line 27, are a strainer 36 for removing frozen asphalt chunks and large impurities which could clog the circulating system 21, a quick disconnect coupling 38 for tank filling operations, and a tank valve 40 for selectively shutting off flow from the tank 30. Within the modular control valve assembly 20, the directional control valve 22 and pressure relief valve 24 have return outlet ports 42, 43 that are connected to form a single return or recirculating line 44 to the asphalt tank 30. The directional control valve 22 includes a transfer outlet 45 connected to a transfer line 46 for handspray and/or asphalt off-loading operations. Flow through the transfer line 46 and to handspray and off-loading outputs is selectively controlled by on/off type valves 47, 48. The modular control valve assembly 20 is connected by a feed line assembly 50 to the spray bar 28 for transferring asphalt to and from the spray bar 28. The directional control valve has a delivery outlet 52 and a return inlet 54 connected with the feed line assembly 50. As shown, the feed line assembly 50 is generally disposed transversely between the tank 30 and the spray bar 28 and connects preferably near the center of the spray bar 28 and orthoganally thereto. The feed line assembly 50 includes a delivery conduit 53 for delivering asphalt to the spray bar and a return conduit 55 for returning asphalt therefrom. The spray bar 28 includes an inlet 29 connected to the delivery conduit 53 and an outlet 31 connected to the return conduit 55. The spray bar 28 also has a plurality of solenoid actuated on/off type nozzles 56 linearly aligned between manifold ends 28A, 28B for uniformly discharging asphalt over a selected surface area. As schematically shown in FIG. 1, the spray bar 28 provides adjacent flow passages with a first top passage 58 from the delivery conduit 53 to the ends 28A, 28B of the spray bar 28 and a second bottom passage 59 from the ends 28A, 28B of the spray bar 28 to the return conduit 55. This provides for continuously positive flow through the spray bar 28 without the need to reverse the flow of asphalt therein. In a preferred embodiment, the bottom passage 59 and outlet 31 are disposed vertically below the top passage 58 and inlet 29 as can be seen better in FIG. 3 and as will be later described in further detail. By connecting the delivery conduit 53 near the center of the spray bar 28 as schematically shown, the pressures at the ends 28A, 28B are substantially equal pressures throughout the length of the spray bar thereby providing for substantially uniform spraying.

Figure 2A:
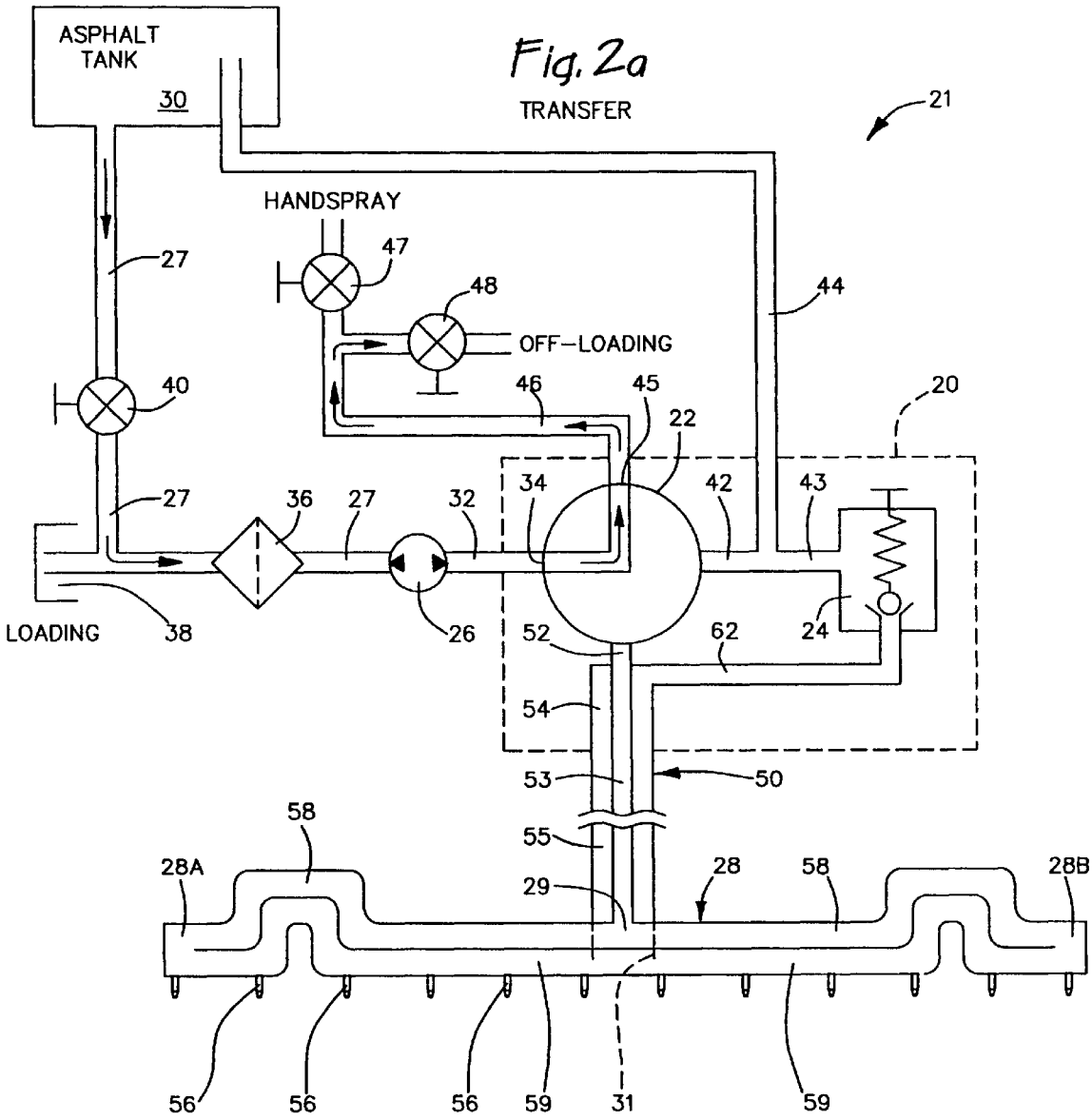
FIGS. 2A, 2B, 2C(i) and 2C(ii) are schematic flow diagrams illustrating the multiple positions and alternative flow paths in the circulating system of FIG. 1.
Figure 2B:
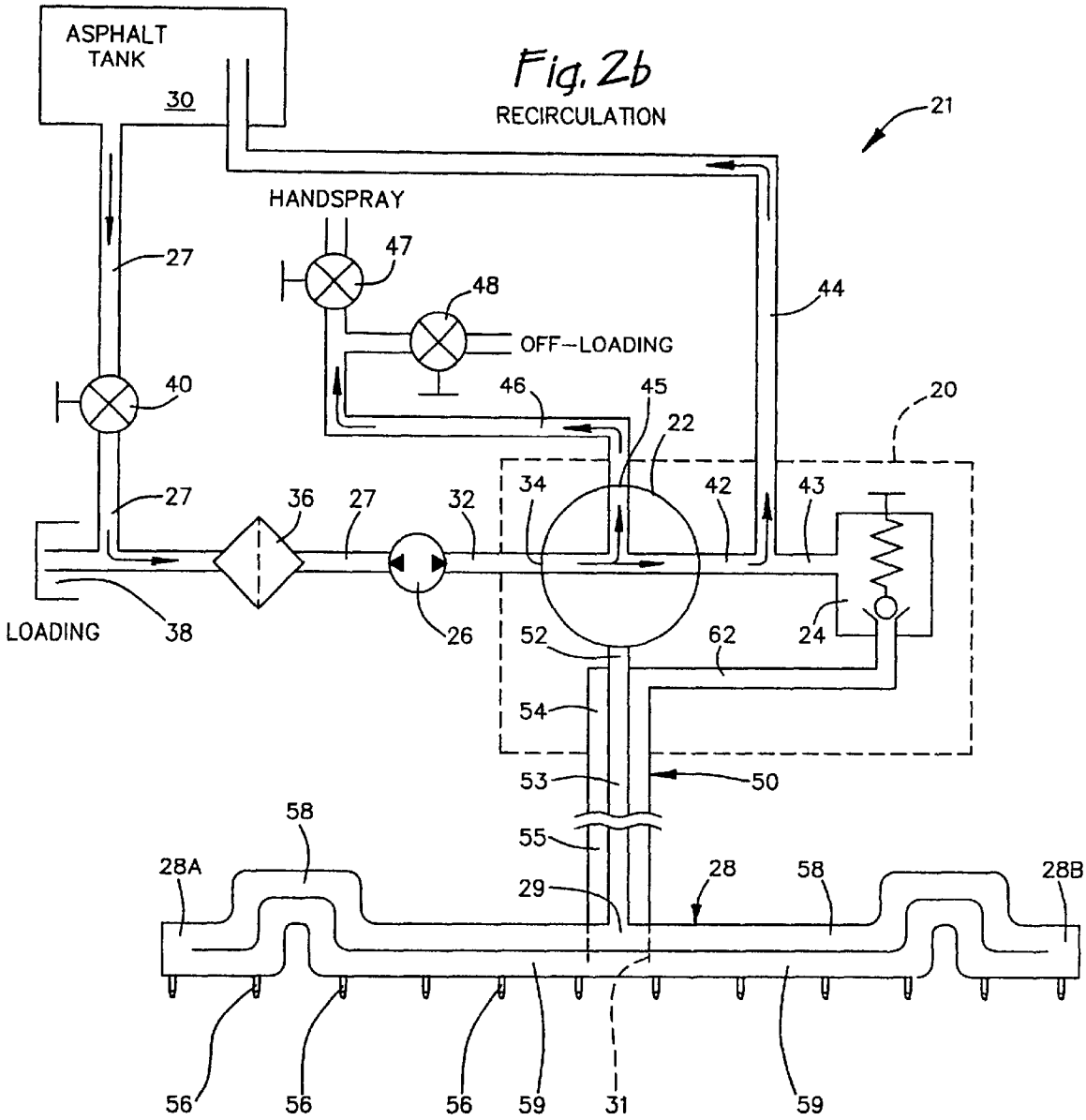
Figure 2C:
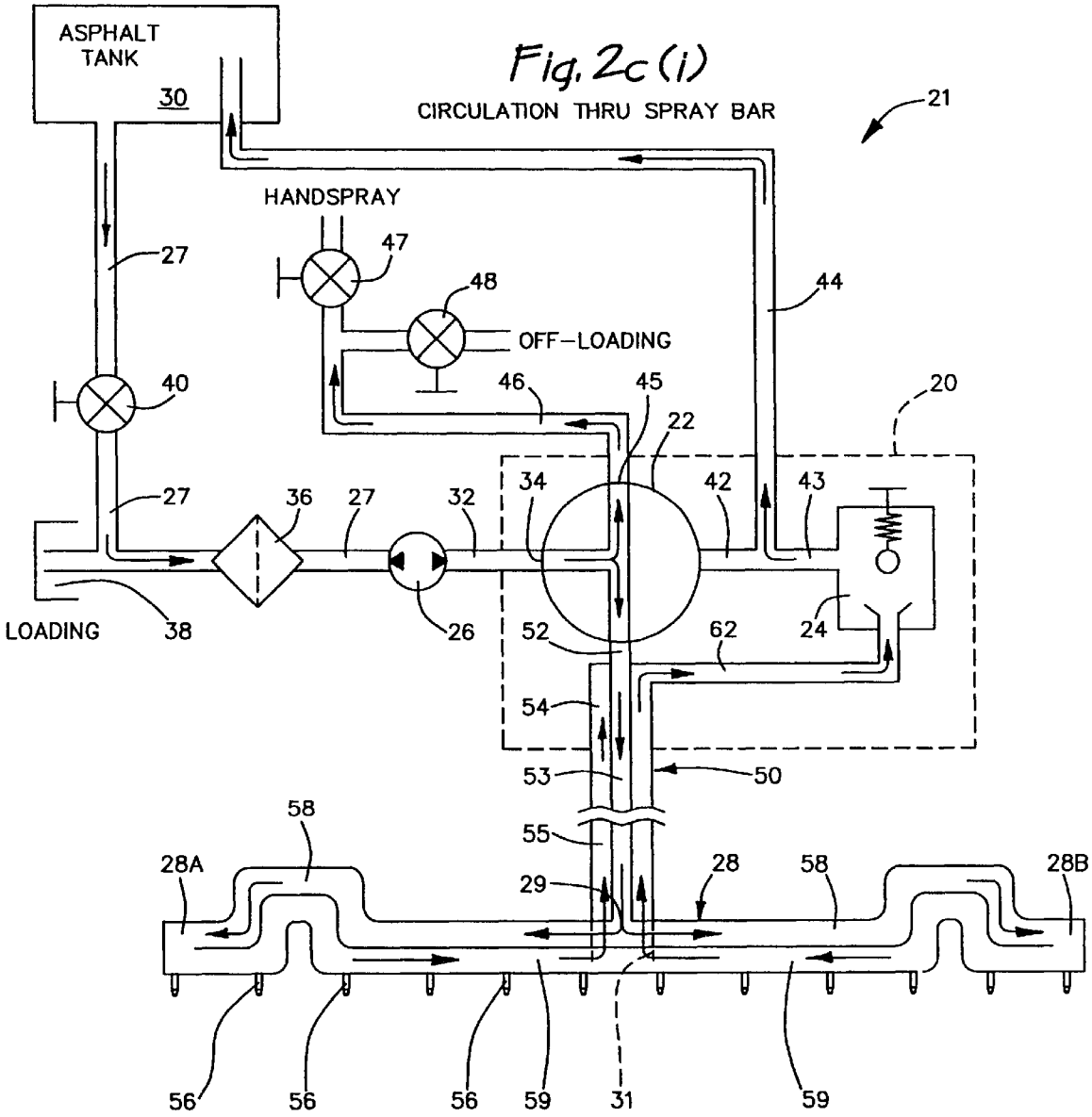

In accordance with the aim of centralizing the control of asphalt flow through the circulation system of an asphalt distributor, and referring to FIGS. 2A, 2B, 2C(i) and 2C(ii), the directional control valve 22 has three positions for directing the flow of asphalt through circulating system 21. In the first position shown in FIG. 2A, the pump 26 is connected to the transfer line 46 and is disconnected from the delivery conduit 53 and the recirculating line 44 for off-loading and handspray operations. In this position, workers can selectively operate valves 47, 48 for handspray and off-loading operations.

In the second position shown in FIG. 2B, the directional control valve 22 connects the pump 26 to the recirculating line 44 while disconnecting the pump from the delivery conduit 53 for tank recirculation mode and tank loading operations. During recirculation mode, asphalt is pumped from the tank 30 to the directional control valve 22 and back to the tank 30 without going through the spray bar 28. Recirculation mode is normally done during initial startup to heat the asphalt and warm up a portion of the circulating system 21 and is also used for handspray operations. During tank loading operations, an external supply line is connected to the quick disconnect coupling 38 whereby the pump 26 delivers asphalt to the tank through the directional control valve 22 and return line 44.

In the third position shown in FIGS. 2C(i) and 2C(ii), the directional control valve 22 connects the pump 26 to the delivery conduit 53 while disconnecting the pump from the recirculating line 44 for spray bar circulating and asphalt spraying modes. During spray bar circulation mode shown in FIG. 2C(i), the nozzles 56 are closed which raises the pressure of asphalt in the spray bar 28 and thereby the pressure at the pressure relief valve 24 causing it to open past its cracking point. This allows the asphalt to flow from the return conduit 55 through the recirculating line 44 and back into the tank 30. Spray bar circulation mode is typically used during initial warming up of the spray bar 28 and nozzles 56 as well as during standby or breaks in operation as when the asphalt distributor is stationary. During the spraying modes shown in FIG. 2C(ii), the directional control valve 22 is in the same position as for the spray bar circulation mode. However, the nozzles 56 are open for discharging the asphalt over a selected surface. With the nozzles 56 open, the pressure in the spray bar 28 is released thereby lowering the asphalt pressure causing the pressure relief valve 24 to close. The cracking point of the pressure relief valve 24 is set between the respective asphalt pressures corresponding to the spray bar circulation and the spraying modes.

In viewing FIG. 2C(ii) of the preferred embodiment, it can be seen that asphalt does not readily flow through the return conduit 55 during the spraying mode. Recalling that asphalt is prone to freeze and cause problems if left to cool, the preferred embodiment prevents asphalt freezing by running the delivery conduit 53 coaxial or otherwise adjacent with the return conduit 55. More specifically, residual asphalt remaining in the return conduit 55 during the spraying mode is heated through heat transfer from the delivery conduit 53 by the asphalt flowing therethrough. Although the coaxial conduits 53, 55 are the preferred way to prevent freezing of asphalt in the return line, other methods may work as well including draining the return conduit 55 during spraying mode or otherwise preventing the asphalt from freezing therein. It is an advantage that the directional control valve 22 does not need to reverse the flow of asphalt in either of the conduits 53, 55 of the feed line assembly 50 during the operating modes. It is another advantage that the directional control valve 22 reduces the amount of valving and external plumbing while providing for numerous desired operating modes of the asphalt distributor. The directional control valve and modular control valve assembly also reduce the costs of providing an asphalt circulating system on an asphalt distributor while also reducing the potential for asphalt freezing and leaks.

Figure 3:
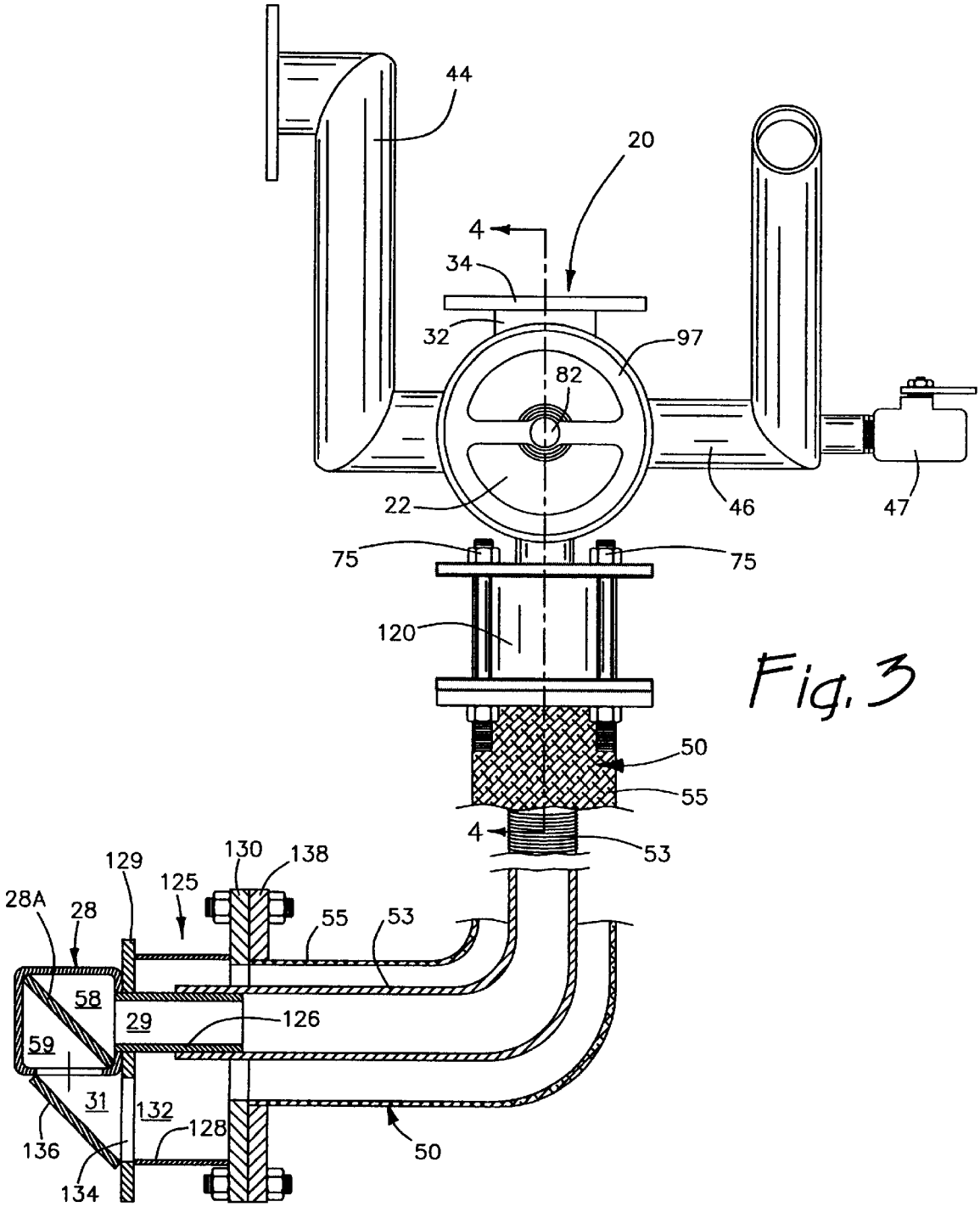
FIG. 3 is a side view of a modular control valve assembly and cross sectional view of a spray bar assembly with a coaxial feed line assembly connecting assemblies according to a preferred embodiment.
Figure 4:
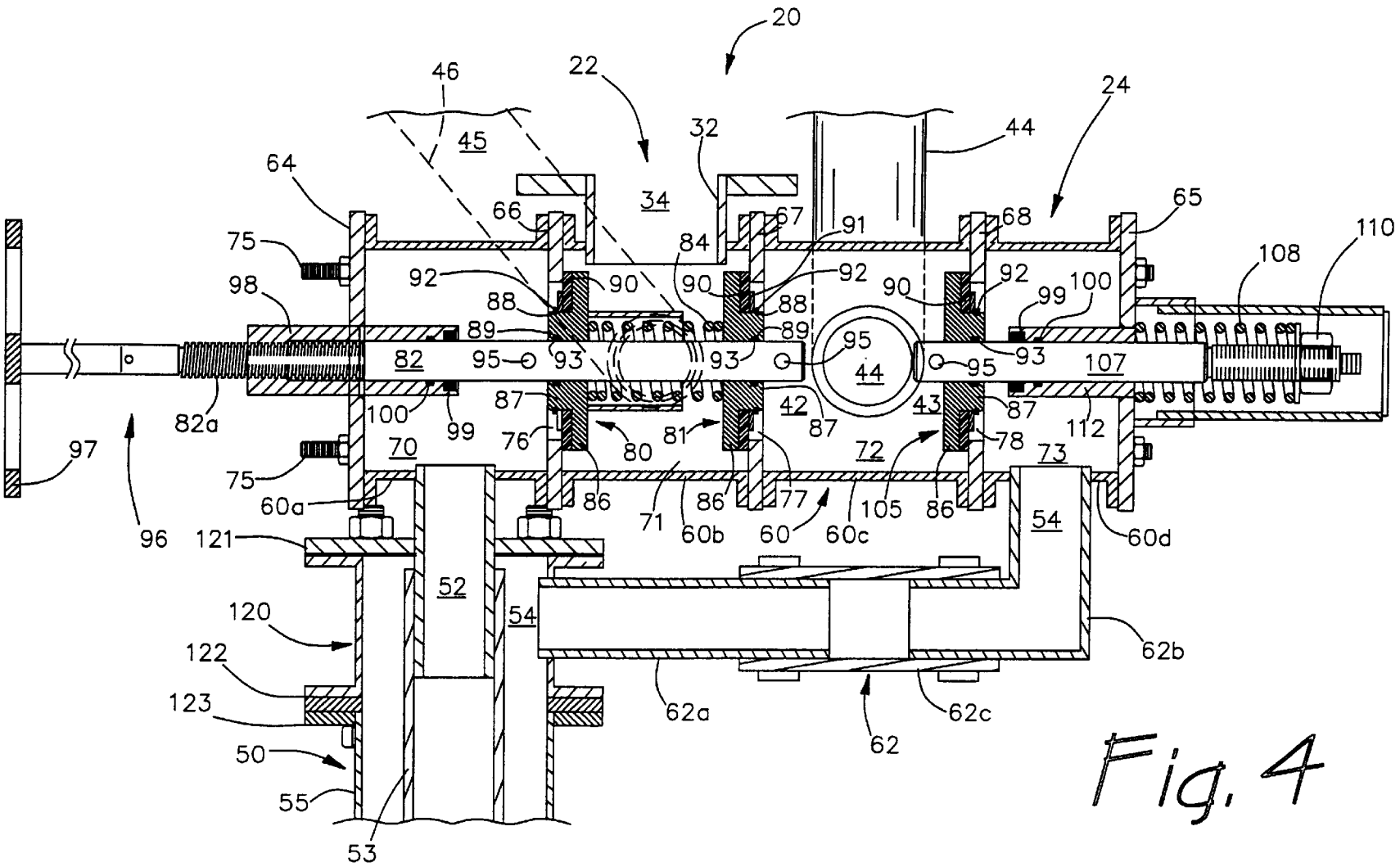
FIG. 4 is a cross-sectional view of the modular control valve assembly of FIG. 3 taken about line 4—4 showing a coaxial outlet connection to a coaxial feed line assembly.

Turning now to FIGS. 3 and 4, a preferred mechanical implementation of the modular control valve assembly 20 is shown. The modular control valve assembly 20 provides an elongate tube-like valve body 60 with a directional control valve generally indicated at 22 and a pressure relief valve generally indicated at 24, both housed therein. The valve body 60 has various pipes welded or otherwise fixed to the body to provide an inlet 34 for receiving pumped asphalt from the pump 26 (FIG. 1), an outlet 44 for returning asphalt to the tank 30 (FIG. 1), a delivery outlet 52 connected to the delivery conduit 53 for delivering asphalt to the spray bar 28 (FIG. 1), and a return inlet 54 connected to the return conduit 55 for receiving circulated asphalt from the spray bar 28 (FIG. 1). An extension line 62 extends the bar feed return inlet 54 to the pressure relief valve 24. In the preferred embodiment, the extension line includes two metal pipes 62*a*, 62*b* and a temperature resistant flexible hose 62*c* clamped therebetween to allow for thermal expansion or misalignments. Fixed on the ends of the valve body 60 are flange like shaft mounting plates 64, 65, with valve seating plates 66, 67, 68 linearly and parallelly spaced and fixed therebetween. Connecting adjacent shaft mounting plates 64, 65 and valve seating plates 66, 67, 68 are tubular body segments 60*a*, 60*b*, 60*c*, and 60*d* which may be formed relatively cheaply from sheet steel with radially outward flange ends abutted against their respective plates 64–68. Each body segment 60*a*–60*d* contains a respective fluid chamber 70, 71, 72, 73. Running through the shaft mounting plates 64, 65 and the valve seating plates 66–68 on the outside of the valve body 60 is a tie rod assembly 75 that includes several nuts and bolts, which ties or clamps the modular control valve assembly 20 together, preferably along with gaskets (not shown) disposed between the body segments 60*a*–60*d* and adjacent plates 64–68 for preventing leakage. As shown in FIG. 4, the fluid chambers 70–73 are in fluid communication with the delivery outlet 52, the inlet 34, the recirculating outlet 44 and return inlet 54, respectively. Each valve seating plate 66–68 defines an annular flow orifice 76, 77, 78 for selectively connecting the chambers 70–73.

To control the flow through the directional control valve 22, the preferred embodiment provides two annular valve members 80, 81 or other movable operator for selectively plugging the respective flow orifices 76, 77. The two valve members 80, 81 are slidably mounted over a linearly translatable screw drive shaft 82. A centering spring 84 concentrically disposed over the shaft 82, or other resilient means, urges the valve members 80, 81 in opposite directions against there respective seating plates 66, 67. In the preferred embodiment, each of the valve members 80, 81 includes a plate portion 86 for seating against the respective seating plates 66, 67 and an axially projecting stem portion 87 that is received into a respective flow orifice 76, 77 for partially plugging the respective flow orifices 76, 77. Each stem portion 87 includes an outer groove 88 and an inner groove 89. Disposed between the valve members 80, 81 and the seating plates 66, 67 are disc shaped gaskets 90 for sealing off the inner chamber 71 from the outside chambers 70, 72 of the directional control valve 22. The gaskets 90 are held in place by retainer discs 91 and snap rings 92 or other such retaining means. The snap rings 92 are fitted in the outer periphery groove 88 to hold the retainer discs 91 and gaskets 90 against the valve members 80, 81. A ring gasket 93 is carried in the inner groove 89 to prevent leakage between the drive shaft 82 and the valve members 80, 81.

The position of the drive shaft 82 determines the position of the valve members 80, 81. A pair of spring pins 95 or other radially projecting members are linearly spaced and fixed on the drive shaft 82 for selectively engaging the valve members 80, 81 as the drive shaft 82 moves. As the shown and oriented in FIG. 4, neither of the spring pins 95 are engaging the valve members 80, 81 which keeps the flow orifices 76, 77 closed and the inlet 34 disconnected from the recirculating and delivery outlets 44, 52, thereby providing for asphalt flow diagrammed in FIG. 2A. As the drive shaft 82 moves to the right, the left spring pin 95 engages the left valve member 80 lifting it off the seating plate 66 and compressing the centering spring 84, which provides for asphalt flow diagrammed in FIGS. 2C(i) and 2C(ii), depending upon the state of the nozzles 56. Likewise, as the drive shaft 82 moves to the left, the right spring pin 95 engages the right valve member 81 lifting it off the seating plate 67 and compressing the centering spring 84, which provides for asphalt flow diagrammed in FIG. 2B. As the drive shaft 82 linearly translates, the centering spring 84 engages the valve members 80, 81 to close the open valve member before allowing the other valve member to open, thereby providing a third position in which the valve members 80, 81 close both flow orifices 76, 77.

Although two different controls and other control means may alternatively be used for each valve member of the directional control valve 22, the preferred embodiment, provides a single control generally indicated at 96 for controlling the position of the drive shaft 82 to thereby provide for the three positions of the directional control valve 22. It is an advantage that providing a single control 96 reduces the complexity of the circulating system which increases worker understanding of how to operate the circulating system 21, and in turn increases worker safety. From the above discussion and the drawings, it will be appreciated to those in the art that the preferred embodiment minimizes the amount of machine tooling and casting to provide the various valve components, thereby keeping cost at a minimum, while providing the various desired operating mode features.

In the preferred embodiment, the control 96 comprises a manually operated wheel 97 coupled to the drive shaft 82 outside the valve body 60. The drive shaft includes a threaded portion 82*a* which is received in a corresponding rotationally fixed threaded sleeve portion 98 of the actuator mounting plate 64. As the wheel 97 and drive shaft 82 rotate, the threads 82*a* of the drive shaft 82 engage the threads of the sleeve portion 98 causing the drive shaft 82 to linearly translate. The sleeve portion 98 also carries a scraper 99 and a ring gasket 100 to prevent asphalt from interfering with the rotation of the drive shaft 82 relative to the sleeve portion 98. In an alternative embodiment, a single control 96 is provided by a single three position pneumatic cylinder (not shown) or other fluid or electrical actuator for linearly translating a drive shaft without rotation. It is an advantage of the alternative embodiment that the control may be remotely controlled.

Also shown in FIGS. 3 and 4 is that directional control valve 22 includes a transfer outlet 45 and conduit 46 connected to the intermediate fluid chamber 71 and thereby the inlet 34 for continuously connection to pump 26 (FIG. 1) during all three positions of the directional control valve 22. Although the transfer line outlet conduit 46 may alternatively be placed upstream of the directional control valve 22, connecting the transfer line 46 directly to the directional control valve 22 has the advantage of increasing heat transfer to other portions of the directional control valve 22 and modular control valve assembly 20 when both valve members 80, 81 are in the closed positions. The increased heat transfer prevents freezing of asphalt in the modular control valve assembly 20 during transfer operations.

In furtherance of the objects of reducing the potential for asphalt leaks and freezing or clogging of the circulation network, the preferred embodiment configures the directional control valve 22 with the pressure relief valve in the same valve body 60 to form the modular control valve assembly 20. In particular, heat transfer through the valve body 60 prevents asphalt freezing in the pressure relief valve 24 when it is not open. Also, the pressure relief valve 24 and directional control valve 22 share intermediate return chamber 72 and the recirculating outlet and line 44, thereby further reducing the lengths of plumbing needed to provide for the circulating system 21.

In the preferred embodiment, the pressure relief valve 24 comprises a valve member 105 mounted on a linearly translatable retaining shaft 107 for engaging the valve seating plate 68 and plugging the respective flow orifice 78. Like the directional control valve 22, associated with the valve member are a disc gasket 90, a retainer disc 91, a snap ring 92, and a inner gasket 93, whose function at this point is understood from the above discussion. A spring pin 95 fixed on the retaining shaft 107 continuously engages the valve member 105. More specifically, a spring 108 engages a nut 110 on the retaining shaft 107 to bias the retaining shaft 107 and valve member 105 against the valve seating plate 68. The spring 108 is compressed between the nut 110 and a mounting sleeve portion 112 of the mounting plate 65 for determining the cracking point at which the valve member 105 will open. Also shown in FIG. 4 are a scraper 99 and gasket 100 carried by inner sleeve 112 for preventing asphalt from interfering with the smooth linearly translation of the retaining shaft 107.

As described above, the pressure relief valve 24 opens during spray bar circulation mode and closes during spraying mode. To provide for this, the cracking point of the pressure relief valve 24 is determined by pre-setting the compression in the spring 108. The nut 110 can be tightened or loosened as desired to control the spring compression and thereby the cracking point of the pressure relief valve 24. It is an advantage that during normal operation of switching between spraying and spray bar circulating modes, the spring compression or cracking point does not need to be adjusted. However it will be appreciated that operating conditions can be different on different days. For example, colder weather often causes an increase in asphalt viscosity which may change the pressure applied to the pressure relief valve 24 in different modes. This may require a minor adjustment of the spring compression or cracking point to compensate for changes in operating pressures.

The modular control valve assembly 20 also has a coaxial inlet/outlet connection generally indicated at 120 that connects with the coaxial feed line assembly 50. In the preferred embodiment, the connection 120 includes the outlet pipe 52 and the return inlet body 54. The extension line 62 connects the return inlet body 54 with the pressure relief valve 24. The delivery conduit 53 of the feed line assembly is closely and slidably fitted over the outlet pipe 52 while the return conduit 55 and the return inlet body 54 includes respective flange portions 121, 122, 123 that are tied together by a tie rod assembly 75 disposed on the outside of the return inlet body 54. The return and delivery conduits 53, 55 of the feed line assembly 50 are preferably built from flexible metal tubing such as commercially available tar and asphalt hose. Advantageously, the preferred embodiment forms a heat exchanger by coaxially disposing the return and delivery conduits 53, 55 to preserve heat therein. As used herein, coaxial means that one conduit is housed inside the other conduit and not necessarily that the conduits have a common center. In the preferred embodiment a common center for the return and delivery conduits 53, 55 does not necessarily exist because of the preferred flexible nature and inherent play in the coaxial feed line assembly which also allows for thermal expansion and small misalignments.

Figure 5:
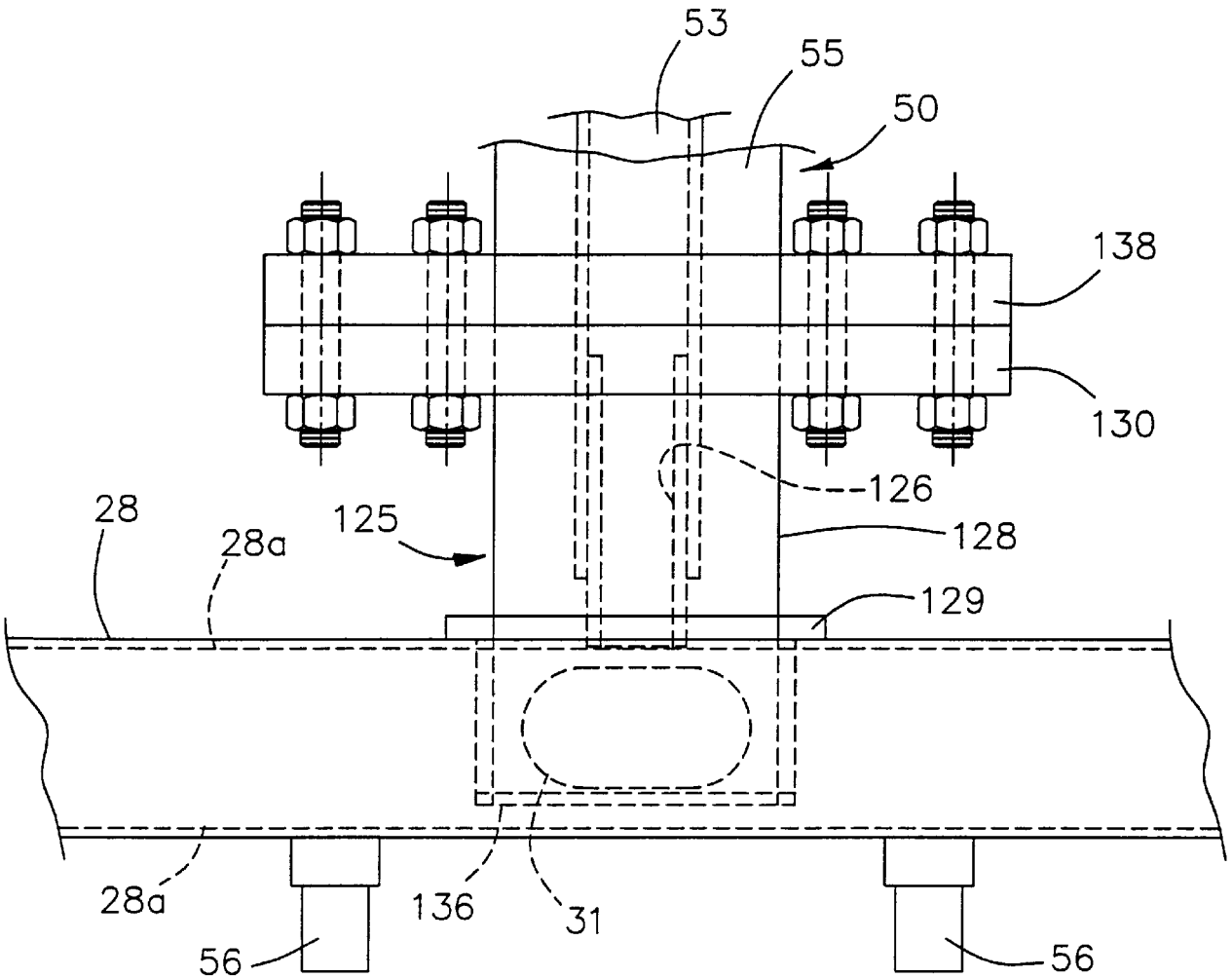
FIG. 5 is a top view of parts of the spray bar shown in FIG. 3.

Referring to FIGS. 3 and 5, the spray bar 28 also includes a coaxial inlet/outlet connection generally indicated at 125 that is preferably located in proximity to the center of is longitudinal axis of the spray bar 28. As shown, the spray bar 28 includes a divider 28*a* therein which splits the spray bar up into the upper and lower flow passages 58, 59. The coaxial connection 125 generally includes a inner duct 126 disposed within an outer duct 128. In greater detail, the inner duct 126 is welded or otherwise fixed to the spray bar 28 in fluid communication with the upper flow passage 58. The delivery conduit 53 is closely fitted into the inner duct 126 to connect the delivery conduit 53 with the upper flow passage 58. The outer duct 128 welded or otherwise fixed between two flanges 129, 130 to provide a chamber 132. The first flange 129 is fixed to the spray bar 28 and includes an flow aperture 134. A hollow body structure 136 is fixed between the first flange 129 and the spray bar 28 for connecting the flow aperture 134 to the bottom flow passage 59 thereby to provide for the spray bar outlet 31. The second flange 130 is fastened to a corresponding flange 138 of the return conduit 55 to connect the return conduit 55 to the outlet 31 and couple the feed line assembly 50 and spray bar 28.

Thus, there has been provided a DIRECTIONAL CONTROL VALVE AND VALVE ASSEMBLY IN AN ASPHALT DISTRIBUTOR which fully satisfies the objects, aims, and advantages set forth above. While the invention has been described in connection with a specific embodiment thereof, it is evident that may alternatives, modifications and variations will be apparent to those skilled in the art in light of the foregoing description. Accordingly, it is intended to embrace all such alternatives, modifications, and variations that fall within the spirit and broad scope of the appended claims.

What is claimed is:

1. An apparatus for controlling the flow of liquid asphalt in an asphalt distributor, the asphalt distributor having a tank, a pump connected to the tank, and a spray bar, comprising:

a directional control valve having an inlet, at least two outlets, and at least three positions, the inlet connected to said pump, said at least two outlets including a first outlet connected to the tank and a second outlet connected to the spray bar, the directional control valve having a first position connecting the inlet to the first outlet, a second position connecting the inlet to the second outlet, and a third position disconnecting the inlet from the first and second outlets; and means in operational communication with the directional control valve for selectively controlling the position of the directional control valve.

2. The apparatus of claim 1 wherein the directional control valve has a third outlet connected to a transfer line, the inlet being continuously connected to said third outlet in all three positions, the transfer line holding an on/off valve for selectively flowing asphalt through the transfer line.

3. The apparatus of claim 1 wherein the inlet is disconnected from the second outlet while in the first position and the inlet is disconnected from the first outlet while in the second position.

4. The apparatus of claim 1 further comprising a pressure relief valve for controlling return flow of liquid asphalt from the spray bar to the tank, the pressure relief valve having a return inlet port connected to the spray bar and an outlet port connected to said first outlet of the directional control valve.

5. The apparatus of claim 1 wherein the pressure relief valve is in thermodynamic communication with the directional control valve to receive sufficient heat therefrom to prevent freezing of static asphalt in the pressure relief valve.

6. The apparatus of claim 4 wherein the second outlet is connected by a delivery conduit to the spray bar and the return inlet port is connected by a return conduit to the spray bar, each conduit having one directional flow, asphalt flowing through the delivery conduit during a spraying mode, and asphalt flowing through the delivery conduit, the spray bar and the return conduit during a spray bar circulating mode.

7. The apparatus of claim 6 wherein the return conduit runs adjacent to the delivery conduit to provide for heat transfer therebetween and thereby prevent freezing of static asphalt in the return conduit during spraying mode.

8. The apparatus of claim 1 wherein the control means is a single manual crank.

9. The apparatus of claim 1 wherein the control means is a single fluid powered actuator having three positions corresponding to the positions of the directional control valve.

10. A directional control valve for controlling the flow of liquid asphalt in an asphalt distributor, the asphalt distributor having a tank, a pump connected to the tank, and a spray bar, comprising:

a valve body having an inlet connected to the pump, a first outlet connected to said tank, and a second outlet connected to the spray bar;

a movable valve operator in the valve body having a first position connecting the inlet to the first outlet for recirculation of asphalt to the tank, a second position connecting the inlet to the second outlet for flowing asphalt to the spray bar, and a third position disconnecting the inlet from the first and second outlets; and a control in operational communication with said valve operator to selectively move the valve operator through said three positions.

11. The directional control valve of claim 10 wherein the valve body defines a third outlet to a transfer line, the inlet being connected to said transfer line in all of said three positions.

12. The directional control valve of claim 11 wherein said movable operator comprises first and second valve members having open and closed positions, the first valve member interposed between the inlet and the first outlet and the second valve member interposed between the inlet and the second outlet, the first valve member being open in the first position, the second valve member being open in the second position, and the first and second valve members being closed in the third position.

13. The directional control valve of claim 12 wherein the valve body comprises first and second seating surfaces for receiving the first and second valve members, respectively, and further including a spring biasing the valve members against their respective seating surfaces, the control including a movable member that alternatively engages the valve members to operatively lift the valve members off of their respective seating surfaces and thereby form flow orifices therebetween.

14. The directional control valve of claim 13 wherein the second outlet forms part of a coaxial connection having a delivery conduit for flowing asphalt to the spray bar and a return conduit returning asphalt from the spray bar.

15. The directional control valve of claim 14 wherein the directional control valve is part of a modular valve assembly, the modular valve assembly including a pressure relief valve in the valve body, the pressure relief valve having a return inlet port connected to the spray bar and an outlet port connected to the second outlet, the pressure relief valve connecting the inlet port to the outlet port at a predetermined pressure thereby allowing for circulation of liquid asphalt through the spray bar and to the tank.

16. The directional control valve of claim 15 wherein the inlet is disconnected from the second outlet while in the first position and the inlet is disconnected from the first outlet while in the second position.

17. A modular control valve assembly for controlling the flow of liquid asphalt in an asphalt distributor, the asphalt distributor having a tank, a pump connected to said tank, a spray bar and a transfer line, comprising:

a valve body having a supply inlet connected to said pump, a first outlet connected to the tank, a second outlet connected to the spray bar, a third outlet connected to the transfer line, and a return inlet connected to the spray bar;

a directional control valve in the valve body having a first position connecting the supply inlet to the first outlet for recirculation of asphalt to the tank, a second position connecting the inlet to the second outlet for flowing asphalt to the spray bar, and a third position connecting the inlet to the third outlet for flowing asphalt through the transfer line;

a pressure relief valve in the valve body interposed between said return inlet and the first outlet;

a control in operational communication with said directional control valve and operable to selectively move the directional control valve through said three positions.

18. The modular control valve assembly of claim 17 wherein said movable operator comprises first and second valve members having open and closed positions, the first valve member interposed between the inlet and the first outlet and the second valve member interposed between the inlet and the second outlet, the first valve member open in the first position, the second valve member open in the second position, and the first and second valve members closed in the third position.

19. The modular control valve assembly of claim 18 wherein the valve body comprises first and second seating surfaces for receiving the first and second valve members, respectively, flow orifices being formed between respective valve seating surfaces and valve members, and further including resilient means for urging the valve members against their respective seat surfaces, the control means including a movable member that engages the valve members to lift the valve members off of their respective seating surfaces.

20. The modular control valve assembly of claim 19 wherein said resilient means comprises a centering spring interposed between said first and second valve members.

21. The modular control valve assembly of claim 20 wherein the second outlet is connected by a delivery conduit to the spray bar and the return inlet is connected by a return conduit to the spray bar, each conduit having one directional flow, asphalt flowing through the delivery conduit during spraying operations, and asphalt flowing through the delivery conduit, the spray bar and the return conduit during spray bar recirculating operation, the return conduit being coaxially disposed with the delivery conduit to provide for heat transfer therebetween and thereby prevent freezing of static asphalt in the return conduit during spraying operations.

* * * * *